US011353212B2

(12) United States Patent
Zink et al.

(10) Patent No.: US 11,353,212 B2
(45) Date of Patent: Jun. 7, 2022

(54) LOW $NO_x$ BURNER APPARATUS AND METHOD

(71) Applicant: ZEECO, INC., Broken Arrow, OK (US)

(72) Inventors: Darton J. Zink, Tulsa, OK (US); Rex K. Isaacs, Collinsville, OK (US); John Petersen, Pawnee, OK (US); Cody Little, Coweta, OK (US); Tim Kirk, Morris, OK (US)

(73) Assignee: ZEECO, INC., Broken Arrow, OK (US)

( * ) Notice: Subject to any disclaimer, the term of this patent is extended or adjusted under 35 U.S.C. 154(b) by 121 days.

(21) Appl. No.: 16/568,519

(22) Filed: Sep. 12, 2019

(65) Prior Publication Data

US 2021/0080101 A1 Mar. 18, 2021

(51) Int. Cl.

| | |
|---|---|
| ***F23C 9/08*** | (2006.01) |
| ***F23C 9/00*** | (2006.01) |
| ***F23D 14/64*** | (2006.01) |
| ***F23D 14/60*** | (2006.01) |
| ***F23D 14/22*** | (2006.01) |

(52) U.S. Cl.

CPC ..... *F23C 9/08* (2013.01); *F23C 9/006* (2013.01); *F23D 14/22* (2013.01); *F23D 14/60* (2013.01); *F23D 14/64* (2013.01); *F23C 2202/20* (2013.01)

(58) Field of Classification Search

CPC ..... F23C 9/006; F23C 9/08; F23C 2202/00; F23C 2202/40; F23C 2202/20; F23D 14/22; F23D 14/58; F23D 14/60; F23D 14/64

See application file for complete search history.

(56) References Cited

U.S. PATENT DOCUMENTS

| | | | | |
|---|---|---|---|---|
| 1,889,548 | A * | 11/1932 | Guay | F23H 13/00 126/163 A |
| 3,905,755 | A | 9/1975 | Aske | |
| 4,277,952 | A | 7/1981 | Egnell et al. | |
| 4,395,223 | A | 7/1983 | Okigami et al. | |

(Continued)

FOREIGN PATENT DOCUMENTS

| | | |
|---|---|---|
| DE | 3628293 | 2/1988 |
| WO | 2021050736 | 3/2021 |

OTHER PUBLICATIONS

PCT/US2019/025508; Corrected International Search Report and Written Opinion; dated Apr. 3, 2019; US.

(Continued)

*Primary Examiner* — Alfred Basichas

(74) *Attorney, Agent, or Firm* — Dennis D. Brown; Brown Patent Law, P.L.L.C.

(57) ABSTRACT

A burner apparatus and method which provide an increased amount of internal flue recirculation for reducing $NO_x$ emissions by ejecting a series of surrounding primary fuel streams and also ejecting on one or more subsequent series of surrounding fuel streams outside of the burner wall toward the burner combustion wherein each succeeding series of surrounding fuel streams must travel a greater distance to the combustion zone and each series of surrounding fuel streams must contact one or more radial impact structures provided on the exterior of the burner wall.

22 Claims, 2 Drawing Sheets

(56) References Cited

U.S. PATENT DOCUMENTS

| | | | | |
|---|---|---|---|---|
| 4,575,332 | A | 3/1986 | Oppenberg et al. | |
| 4,708,638 | A | 11/1987 | Brazier et al. | |
| 5,044,932 | A | 9/1991 | Martin et al. | |
| 5,073,105 | A | 12/1991 | Martin et al. | |
| 5,134,985 | A | 8/1992 | Rao | |
| 5,195,884 | A | 3/1993 | Schwartz et al. | |
| 5,284,438 | A | 2/1994 | McGill et al. | |
| 5,441,404 | A | 8/1995 | Christenson | |
| 5,458,481 | A | 10/1995 | Surbey et al. | |
| 5,542,840 | A | 8/1996 | Surbey et al. | |
| 5,713,206 | A * | 2/1998 | McWhirter | F23R 3/346 60/747 |
| 5,799,594 | A | 9/1998 | Rao | |
| 5,957,678 | A * | 9/1999 | Endoh | F23G 7/065 431/5 |
| 5,980,243 | A | 11/1999 | Surbey et al. | |
| 6,007,325 | A | 12/1999 | Loftus et al. | |
| 6,089,170 | A | 7/2000 | Conti et al. | |
| 6,394,792 | B1 | 5/2002 | McDonald et al. | |
| 6,499,990 | B1 * | 12/2002 | Zink | F23C 9/006 431/115 |
| 6,626,661 | B1 | 9/2003 | Zink | |
| 6,875,008 | B1 * | 4/2005 | Martin | F23C 6/047 431/116 |
| 7,198,482 | B2 * | 4/2007 | Chung | F23C 6/047 431/116 |
| 7,670,135 | B1 * | 3/2010 | Zink | F23M 5/025 431/9 |
| 9,222,668 | B2 | 12/2015 | Zink et al. | |
| 9,593,847 | B1 * | 3/2017 | Zink | F23D 14/62 |
| 9,593,848 | B2 | 3/2017 | Zink et al. | |
| 9,835,089 | B2 * | 12/2017 | Zuo | F23R 3/346 60/747 |
| 2001/0018171 | A1 | 8/2001 | Al-Halbouni | |
| 2001/0034001 | A1 | 10/2001 | Poe et al. | |
| 2013/0122440 | A1 * | 5/2013 | Zink | F23C 9/006 431/354 |
| 2013/0230811 | A1 | 9/2013 | Goodson et al. | |
| 2014/0065558 | A1 | 3/2014 | Colannino et al. | |
| 2017/0198902 | A1 | 7/2017 | Zink et al. | |
| 2019/0309942 | A1 * | 10/2019 | Zink | F23H 13/00 126/163 A |

OTHER PUBLICATIONS

PCT/US2020/050211—International Preliminary Report With International Search Report and Written Opinion; datd Dec. 3, 2020.

* cited by examiner

LOW $NO_x$ BURNER APPARATUS AND METHOD

FIELD OF THE INVENTION

The present invention relates to burner apparatuses and methods for reducing $NO_x$ emissions from heaters, boilers, incinerators, other fired heating systems, and other combustion systems of the type used in refineries, power plants, and chemical plants, and in other industrial services and facilities.

BACKGROUND OF THE INVENTION

A continuing need exists for burners and burner combustion methods which will significantly reduce $NO_x$ emissions from fired heaters, boilers, incinerators, and other combustion systems used in industrial processes. The improved burners will also preferably provide flame lengths, turndown ratios, and stability levels which are at least as good as or better than those provided by the current burner designs.

For burners which are used in industrial applications, if the burner fuel is thoroughly mixed with air and combustion occurs under ideal conditions, the resulting combustion products are primarily carbon dioxide and water vapor. However, when the fuel is burned under less than ideal conditions, e.g., at a high flame temperature, nitrogen present in the combustion air reacts with oxygen to produce nitrogen oxides ($NO_x$). Other conditions being equal, $NO_x$ production increases as the temperature of the combustion process increases. $NO_x$ emissions are generally considered to contribute to ozone depletion, acid rain, smog, and other environmental problems.

For gaseous fuels with no fuel bound nitrogen, thermal $NO_x$ is the primary mechanism for $NO_x$ production. Thermal $NO_x$ is produced when the flame reaches a high enough temperature to break the covalent $N_2$ bond so that the resulting "free" nitrogen atoms bond with oxygen to form $NO_x$.

Typically, the temperature of combustion is not great enough to break all of the $N_2$ bonds. Rather, most of the nitrogen in the air stream passes through the combustion process and remains as diatomic nitrogen ($N_2$) in the combustion products. However, some of the $N_2$ will typically reach a high enough temperature in the high intensity regions of the flame to break the $N_2$ bond and form "free" nitrogen. Once the covalent nitrogen bond is broken, the "free" nitrogen is available to bond with other atoms. Fortunately, the free nitrogen will most likely react with other free nitrogen atoms to form $N_2$. However, if another free nitrogen atom is not available, the free nitrogen will react with oxygen to form $NO_x$.

As the temperature of the burner flame increases, the stability of the $N_2$ covalent bond decreases, causing increasing production of free nitrogen and thus also increasing the production of thermal $NO_x$ emissions. Consequently, in an ongoing effort to reduce $NO_x$ emissions, various types of burner designs and theories have been developed with the objective of reducing the peak flame temperature.

The varied requirements of refining, power generation, petrochemical processes, and other processes necessitate the use of numerous different types and configurations of burners. The approaches used to lower $NO_x$ emissions can differ from application to application. However, thermal $NO_x$ reduction is generally achieved by slowing the rate of combustion. Since the combustion process is a reaction between oxygen and the burner fuel, the objective of delayed combustion is typically to reduce the rate at which the fuel and oxygen mix together and burn. The faster the oxygen and the fuel mix together, the faster the rate of combustion and the higher the peak flame temperature.

Examples of different types of burner design approaches used for reducing $NO_x$ emissions have included:

(a) Staged air designs wherein the combustion air is typically separated into two or more flows to create separate stages of lean and rich combustion.

(b) Designs using Internal Flue Gas Recirculation (IFGR) wherein internal flow momentum is used to cause some of the flue gas (i.e., the inert products of combustion) in the combustion system to recirculate back into the combustion zone to form a diluted combustion mixture which burns at a lower peak flame temperature.

(c) Staged fuel designs wherein (i) all or part of the fuel is introduced outside of the combustion air stream so as to delay mixing the fuel with the combustion air stream, creating a fuel-air mixture which burns at a lower peak flame temperature or (ii) part of the fuel is introduced outside of the primary flame envelope to stage the flame and combust the fuel in the presence of the products of combustion from the primary flame.

(d) Designs using External Flue Gas Recirculation (EFGR) wherein the burner typically uses an external air blower which supplies combustion air to the burner and also includes an external piping arrangement which draws flue gas from the combustion chamber into the suction of the blower. This flue gas mixes with the combustion air stream to reduce the oxygen concentration of the air stream supplied to the burner, which in turn lowers the peak flame temperature.

(e) Designs using "flameless" combustion wherein most, or all, of the burner fuel passes through and mixes with inert products of combustion to form a diluted fuel which burns at a lower peak flame temperature. The mixture of fuel and inert products of combustion can be as high as 90% inert, thus resulting in a "transparent" flame.

(f) Designs using steam and/or inert injection into the burner fuel wherein the steam or inert component mixes with the fuel so that the resulting composition will burn at a lower peak flame temperature.

(g) Designs using steam and/or inert injection into the combustion air stream wherein the steam and/or inert components mix with the combustion air so that the resulting composition will burn at a lower peak flame temperature.

(h) Designs using high excess air levels to dilute products of combustion and produce low flame temperatures, such as surface stabilized combustion burners.

SUMMARY OF THE INVENTION

The present invention provides a low $NO_x$ burner apparatus and method which satisfy the needs and alleviate the problems discussed above. The inventive burner apparatus and method provide a significantly increased amount internal flue gas recirculation (IFGR) while maintaining or improving the stability of the burner. The inventive burner and method will typically provide from about 16 to about 24 pounds of IFGR per pound of burner fuel and will provide significantly reduced $NO_x$ emissions levels in the range of from 12 ppmv to 5 ppmv or less. In addition, the inventive burner apparatus and method can be used in most types of fired heaters, boilers, incinerators, and other combustion systems used in industrial processes.

In one aspect, there is provided a burner apparatus for discharging a burner flame in a heating system having gaseous products of combustion therein. The burner apparatus preferably comprises at least: (i) a burner wall having a forward longitudinal end and an exterior, (ii) a flow passageway for air or other oxygen source which extends through and is at least mostly surrounded by the burner wall, the flow passageway having a discharge at the forward longitudinal end of the burner wall; (iii) a combustion zone of the burner apparatus which has a beginning end located substantially at the forward longitudinal end of the burner wall; (iv) a series of primary fuel ejection structures which are positioned outside of and which at least partially surround the flow passageway, the primary fuel ejection structures being located rearwardly of and radially outward from the forward longitudinal end of the burner wall and each of the primary fuel ejection structures being oriented to eject a primary fuel stream along a primary fuel flow path outside of the burner wall toward the combustion zone; (v) at least one primary radial impact structure which is provided on the exterior of the burner wall and is positioned in the primary fuel flow paths for contacting by at least a portion of the primary fuel stream ejected by each of the primary fuel ejection structures; (vi) a series of secondary fuel ejection structures which are positioned outside of and which at least partially surround the flow passageway, the secondary fuel ejection structures being located rearwardly of and radially outward from the primary fuel ejection structures and each of the secondary fuel ejection structures being oriented to eject a secondary fuel stream along a secondary fuel flow path outside of the burner wall toward the combustion zone; and (vii) at least one secondary radial impact structure which is provided on the exterior of the burner wall and is positioned rearwardly of the at least one primary radial impact structure, in the secondary fuel flow paths, for contacting by at least a portion of the secondary fuel stream ejected by each of the secondary fuel ejection structures.

In another aspect, the at least one primary radial impact structure on the exterior of the burner wall can optionally also be positioned in the secondary fuel flow paths for contacting by at least a portion of the secondary fuel steam ejected by each of the secondary fuel ejection structures.

In another aspect, the combustion zone of the inventive burner apparatus can optionally be a single stage combustion zone having only one combustion stage for combusting both the primary fuel streams ejected from the primary fuel ejection structures and the secondary fuel streams ejected from the secondary fuel ejection structures.

In another aspect, the inventive burner apparatus can optionally further include: (a) a series of tertiary fuel ejection structures which are positioned outside of and which at least partially surround the flow passageway, the tertiary fuel ejection structures being located rearwardly of and radially outward from the secondary fuel ejection structures and each of the tertiary fuel ejection structures being oriented to eject a tertiary fuel stream along a tertiary fuel flow path outside of the burner wall toward the combustion zone and (b) at least one tertiary radial impact structure which is provided on the exterior of the burner wall and is positioned rearwardly of the at least one secondary radial impact structure, in the tertiary fuel flow paths, for contacting by at least a portion of the tertiary fuel stream ejected by each of the tertiary fuel ejection structures.

In another aspect, there is provided a method of reducing $NO_x$ emissions from a burner apparatus. The method preferably comprises the steps of: (a) discharging air or other oxygen source into a combustion zone from a discharge opening of a flow passage which is at least partially surrounded by a burner wall, the discharge opening of the flow passage being located at a forward end of a burner wall, the burner wall having an exterior, and the combustion zone having a beginning end which is located substantially at the forward end of the burner wall; (b) ejecting primary fuel streams outside of the burner wall toward the combustion zone from a plurality of primary fuel ejection structures, wherein at least a portion of each of the primary fuel streams contacts at least one primary radial impact structure which is provided on the exterior of the burner wall; and (c) ejecting secondary fuel streams outside of the burner wall toward the combustion zone from a plurality of secondary fuel ejection structures, wherein the secondary fuel ejection structures are located rearwardly of and radially outward from the primary fuel ejection structures, at least a portion of each of the secondary fuel streams contacts at least one secondary radial impact structure which is provided on the exterior of the burner wall, and the at least one secondary radial impact structure is positioned rearwardly of the at least one primary radial impact structure.

In another aspect, at least a portion of each of the secondary fuel streams ejected in step (c) of the inventive method can optionally also contact the at least one primary radial impact structure.

In another aspect, the inventive method can also optionally include both (i) at least a portion of each of the primary fuel streams being delivered to and combusted at the beginning end of the combustion zone and (ii) at least a portion of each of the secondary fuel streams being delivered to and combusted at the beginning end of the combustion zone.

In another aspect, the inventive method can further include the step of ejecting tertiary fuel streams outside of the burner wall toward the combustion zone from a plurality of tertiary fuel ejection structures, wherein the tertiary fuel ejection structures are located rearwardly of and radially outward from the secondary fuel ejection structures, at least a portion of each of the tertiary fuel streams contacts at least one tertiary radial impact structure which is provided on the exterior of the burner wall, and the at least one tertiary radial impact structure is positioned rearwardly of the at least one secondary radial impact structure.

Further aspects, features, and advantages of the present invention will be apparent to those in the art upon examining the accompanying drawings and upon reading the following Detailed Description of the Preferred Embodiments.

DETAILED DESCRIPTION OF THE PREFERRED EMBODIMENTS

Before explaining the present invention in detail, it is important to understand that the invention is not limited in its application to the details of the preferred embodiments and steps described herein. The invention is capable of other embodiments and of being practiced or carried out in a variety of ways. It is to be understood that the phraseology and terminology employed herein are for purposes of description and not of limitation.

Also, unless otherwise specified, the inventive features, structures, and steps discussed herein can be advantageously employed using any number or type of fuel ejection tips or other structures. In addition, the inventive burners described herein can be single stage burners or burners using staged fuel and/or staged air designs.

Figure 1:
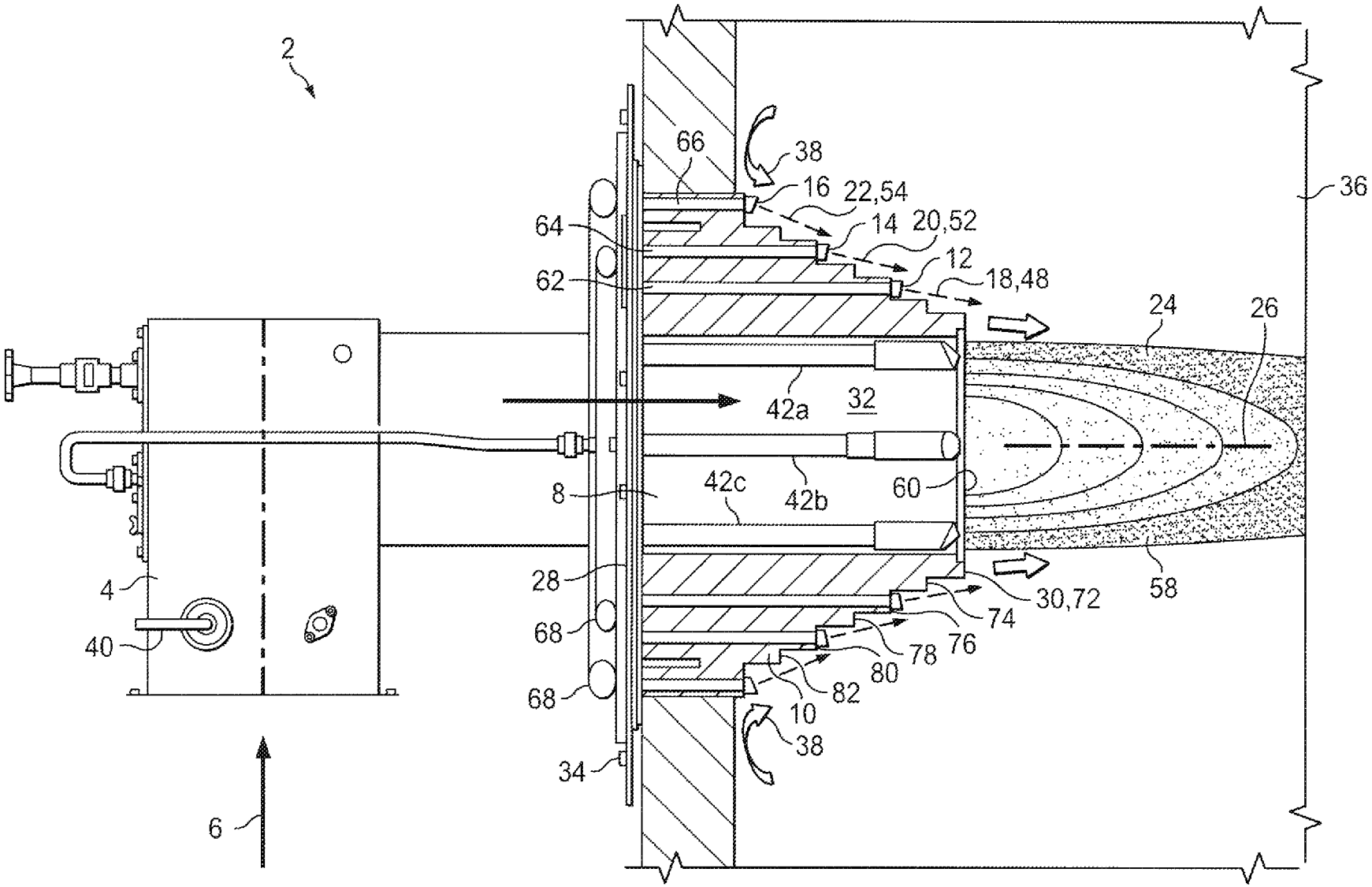
FIG. 1 is a partially cutaway elevational side view of an embodiment 2 of the burner apparatus provided by the present invention.
Figure 2:
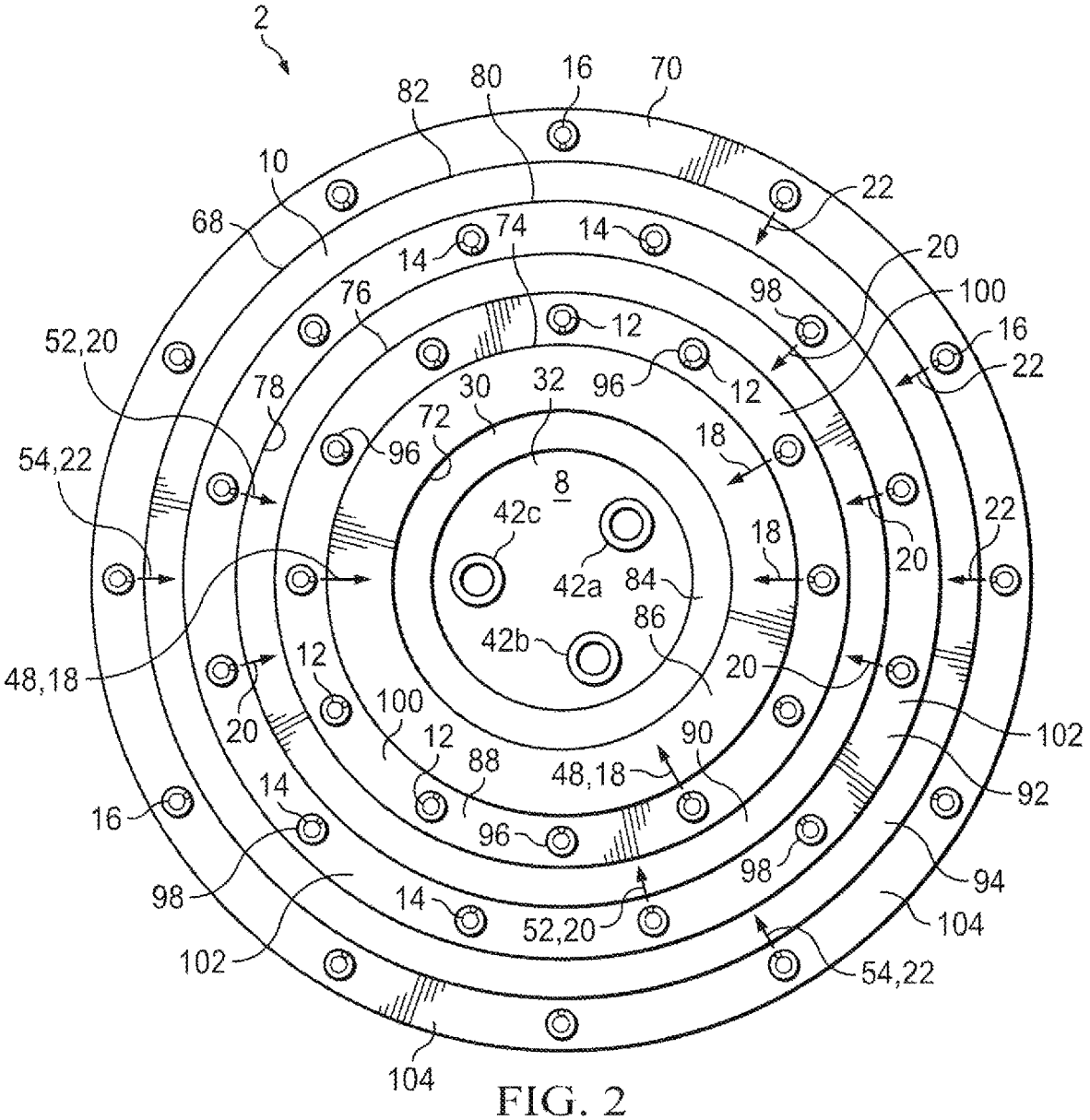
FIG. 2 is a plan view of the inventive burner apparatus 2.

An embodiment 2 of the burner apparatus provided by the present invention is illustrated in FIGS. 1 and 2. The inventive burner 2 preferably comprises: a housing 4 which receives an air stream or other oxygen source 6 and delivers the oxygen source stream 6 to a flow passageway 8; a burner wall 10 which surrounds, or at least partially surrounds, the flow passageway 8 for the oxygen source stream 6; and at least two (more preferably three or more) series of fuel ejection structures 12, 14, 16 which eject fuel streams 18, 20, 22 outside of the burner wall 10 toward a burner combustion zone 24 which projects forwardly from the burner body 10. The burner wall 10 has a longitudinal axis 26, a rearward longitudinal end 28, and a forward longitudinal end 30. The flow passageway 8 for the oxygen source stream 6 extends longitudinally through the burner wall 10 and has a forward discharge opening 32 at the forward longitudinal end 30 of the burner wall 10.

The inventive burner 2 is shown as installed through the wall 34 of a combustion chamber 36. The inventive burner apparatus 2 can be used to heat the combustion chamber 36 of generally any type of fired heating system. The combustion chamber 36 is filled with the gaseous inert products of combustion (i.e., flue gas) 38 produced in the combustion chamber 36 by the burner combustion process. In addition, although the inventive burner apparatus 2 is illustrated in FIG. 1 as being horizontally installed in a vertical wall 34 of the combustion chamber 36, it will be understood that the inventive burner 2 can be alternatively be installed in a floor or ceiling of the combustion chamber 36 and can be oriented horizontally, upwardly, downwardly, or at generally any other desired operating angle.

The combustion air stream or other oxygen source 6 is received in the housing 4 of the inventive burner 2 and is directed into the rearward longitudinal end 28 of burner flow passageway 8. The quantity of combustion air or other oxygen source entering the housing 4 can be regulated, for example, by an air inlet damper 40. The oxygen source stream 6 can be provided to housing 4 as necessary by forced circulation, natural draft, a combination thereof, or in any other manner employed in the art. The oxygen source stream 6 will preferably be air which is delivered to the inventive burner assembly 2 by forced circulation, natural draft, a combination thereof.

As used herein and in the claims, unless otherwise stated, it will also be understood that the oxygen source stream 6 which travels through the flow passageway 8 of the inventive burner 2 can be, for example, 100% air or can be a mixture of combustion air and/or other oxygen source with one or more other components such as, but not limited to, (i) one or more externally recirculated inert (i.e., non-flammable) components such as flue gas, (ii) steam, (iii) $CO_2$, and/or (iv) $N_2$. However, the air or other oxygen source stream 6 preferably will not contain any fuel gas or other fuel material. In addition, except for one or more burner pilot assemblies 42*a*, 42*b*, 42*c* for initiating and maintaining combustion in the combustion zone 24 which projects from the forward end 30 of the burner wall 10, no fuel tips or other fuel ejection structures will preferably be located in or extend through the flow passageway 8 for the oxygen source stream 6.

Although other structures and materials of construction can alternatively be used, the burner wall 10 is preferably constructed of a high temperature refractory burner tile material.

As mentioned above, the inventive burner apparatus 2 includes two, three, four, or more series of surrounding fuel ejection structures wherein the fuel ejection structures in each series (a) are positioned outside of and radially surround, or at least partially surround, the flow passageway 8 for the oxygen source stream 6 and (b) eject gas or liquid fuel streams, preferably gas fuel streams, toward the combustion zone 24 which projects from the forward end 30 of the burner wall 10. Proceeding rearwardly from the forward end 30 of the burner wall 10, each succeeding series of surrounding fuel injection structures will preferably be located rearwardly of and radially outward from the preceding series of surrounding fuel injection structures.

By way of example, but not by way of limitation, the multiple series of fuel ejection structures used in the embodiment 2 of the inventive burner apparatus illustrated in FIGS. 1 and 2 comprise: (1) a series of primary fuel ejection tips, nozzles, or other structures 12 which at least partially surround the flow passageway 8 and are positioned rearwardly of and radially outward from the forward end 30 of the burner wall 10; (2) a series of secondary fuel ejection tips, nozzles, or other structures 14 which at least partially surround the flow passageway 8 and are positioned rearwardly of and radially outward from the primary fuel ejection structures 12; and (3) a series of tertiary fuel ejection tips, nozzles, or other structures 16 which at least partially surround the flow passageway 8 and are positioned rearwardly of and radially outward from the secondary fuel ejection structures 14.

Each of the fuel ejection structures 12, 14, and 16 can have one or more ejection ports of any desired shape. Each fuel ejection structure 12, 14, and 16 will preferably have only a single ejection port, which will also preferably be circular in shape.

The primary fuel ejection structures 12 are configured and oriented to eject primary fuel streams 18 in free jet flow outside of the burner wall 10 along primary fuel flow paths 48 toward the combustion zone 24. The secondary fuel ejection structures 14 are configured and oriented to eject secondary fuel streams 20 in free jet flow outside of the burner wall 10 along secondary fuel flow paths 52 toward the combustion zone 24. The tertiary fuel ejection structures 16 are configured and oriented to eject tertiary fuel streams 22 in free jet flow outside of the burner wall 10 along tertiary fuel flow paths 56 toward the combustion zone 24.

As will be understood by those skilled in the art, the term "free jet," as used herein and in the claims, refers to a jet flow issuing from a fuel tip, nozzle or other ejection structure into a fluid which, compared to the jet flow, is more at rest. In this case, the fluid substantially at rest is the flue gas 38 which is present within the combustion chamber 36. The free jet flow of the primary, secondary, and tertiary fuel streams 18, 20, and 22 operates to entrain flue gas 38 and to thoroughly mix the flue gas 38 with each fuel stream 18, 20, and 22 as it travels to the combustion zone 24 at the outlet end of the burner wall 10.

The combustion zone 24 of the inventive burner 2 can be a multistage combustion zone or can be a single stage combustion zone having only a single combustion stage 58. The combustion zone 24 is preferably a single stage combustion zone wherein all of the primary fuel streams 18, secondary fuel streams 20, and tertiary fuel streams 22 are delivered to, and combusted in, the same combustion stage 58. Most preferably, at least a portion of each primary, secondary, and tertiary fuel stream 18, 20, and 22 is delivered to and combusted at the beginning end 60 of the combustion zone 24. The beginning 60 of the combustion zone 24 is preferably located substantially at (i.e. either at or within 8 (Normally 0.5) inches rearwardly or 0 to 60 (Normally 0) inches forwardly of) the forward end 30 of the burner wall 10.

In the inventive burner 2, each fuel ejection structure 12, 14, and 16 is depicted as being a fuel ejection tip which is secured on the end of a riser or other fuel conduit 62, 64, or 66 which is connected to a fuel supply manifold 68 located outside of the wall 34 of the combustion chamber 36. Each fuel riser 62, 64 and 66 extends through the wall 34 of the combustion chamber 36 and then longitudinally through a surrounding outer skirt portion 68 of the burner wall 10.

As the ejected primary, secondary, and tertiary fuel streams 18, 20, and 22 flow outside of the burner wall 10 within the combustion chamber 36, flue gas 38 from the combustion chamber 36 is entrained in each of the ejected fuel streams 18, 20, and 22 and is mixed therewith. In addition, in order to stabilize and increase the amount of flue gas 38 which mixes with each of the primary, secondary, and tertiary fuel streams 18, 20, and 22, and to stabilize the combustion zone 24 and the combustion flame, each of the primary, secondary, and tertiary flow streams 18, 20, and 22 is oriented and directed to contact at least one radial impact structure which is formed or other otherwise provided on and around, or at least partially around, the exterior 70 of the outer skirt 68 of the burner wall 10.

Each such impact structure can generally be any type of obstruction which will decrease the flow momentum and/or increase the turbulence of the fuel streams 18, 20, or 22 sufficiently to promote flue gas entrainment and mixing while allowing the resulting mixture to flow on to combustion zone 24. Proceeding rearwardly from the forward end 30 of the burner wall 10, each succeeding radial impact structure is preferably broader in diameter or width than, and is located longitudinally rearward of and laterally outward from, the previous impact structure.

In the embodiment 2 of the inventive burner apparatus illustrated in FIGS. 1 and 2, the radial impact structures provided on the exterior 70 of the burner wall 10 preferably comprise: (1) a forward primary impact structure 72 which is positioned in the primary fuel flow paths 48 of the primary ejection structures 12 so that at least a portion of each primary fuel stream 18 contacts the forward primary impact structure 72; (2) a rearward primary impact structure 74 which is rearward of the forward primary impact structure 72 and is positioned in the primary fuel flow paths 48 of the primary ejection structures 12 so that at least a portion of each primary fuel stream 18 also contacts the rearward primary impact structure 74; (3) a forward secondary impact structure 76 which is rearward of the rearward primary impact structure 74 and is positioned in the secondary fuel flow paths 52 of the secondary ejection structures 14 so that at least a portion of each secondary fuel stream 20 contacts the forward secondary impact structure 76; (4) a rearward secondary impact structure 78 which is rearward of the forward primary impact structure 76 and is positioned in the secondary fuel flow paths 52 of the secondary ejection structures 14 so that at least a portion of each secondary fuel stream 20 also contacts the rearward secondary impact structure 78; (5) a forward tertiary impact structure 80 which is rearward of the rearward secondary impact structure 78 and is positioned in the tertiary fuel flow paths 56 of the tertiary ejection structures 16 so that at least a portion of each tertiary fuel stream 22 contacts the forward tertiary impact structure 80; and (6) a rearward tertiary impact structure 82 which is rearward of the forward tertiary impact structure 80 and is positioned in the tertiary fuel flow paths 56 of the tertiary ejection structures 16 so that at least a portion of each tertiary fuel stream 22 also contacts the rearward tertiary impact structure 82.

In addition, in order to provide an even greater amount of IFGR and mixing in the secondary and tertiary fuel streams 20 and 22, the forward and rearward primary radial impact structures 72 and 74 are preferably also positioned in the secondary and tertiary fuel flow paths 52 and 56 so that at least a portion of each secondary fuel stream 20 and at least a portion of each tertiary fuel stream 22 also contacts the primary radial impact structures 20 and 22. Moreover, a further amount of IFGR and mixing are also provided by positioning the forward and rearward secondary radial impact structures 76 and 78 in the tertiary fuel flow paths 56 so that at least a portion of each tertiary fuel stream 22 also contacts the forward and rearward secondary radial impact structures 76 and 78.

In the embodiment 2 of the inventive burner apparatus illustrated in FIGS. 1 and 2, the primary, secondary, and tertiary radial impact structures are most preferably formed such that: (1) the forward primary radial impact structure 72 is a radial ledge formed by the forward longitudinal end 30 of the burner wall 10; (2) the rearward primary radial impact structure 74 is a radial ledge which is formed on the exterior 70 of the burner wall 10 and has an outer diameter (in the case of a circular burner) or width (in the case of a square, rectangular, oval, or other non-circular burner) which is greater than the outer diameter or width of the forward longitudinal end 30 of the burner wall 10; (3) the forward secondary radial impact structure 76 is a radial ledge which is formed on the exterior 30 of the burner wall 10 and has an outer diameter or width which is greater than the outer diameter or width of the rearward primary radial impact structure 74; (4) the rearward secondary radial impact structure 78 is a radial ledge which is formed on the exterior 70 of the burner wall 10 and has an outer diameter or width which is greater than the outer diameter or width of the forward secondary radial impact structure 76; (5) the forward tertiary radial impact structure 80 is a radial ledge which is formed on the exterior 70 of the burner wall 10 and has an outer diameter or width which is greater than the outer diameter or width of the rearward secondary radial impact structure 78; and (6) the rearward tertiary radial impact structure 82 is a radial ledge which is formed on the exterior 70 of the burner wall 10 and has an outer diameter or width which is greater than the outer diameter or width of the forward tertiary radial impact structure 80.

During the operation of the inventive burner 2, the contacting flow and momentum of the primary, secondary, and tertiary fuel streams 18, 20 and 22, and the flow and the momentum of the air or other oxygen source stream 6 flowing from forward discharge opening 32 at the forward end 30 of the burner wall 10, results in the creation of reduced pressure areas on the forward faces 84, 86, 88, 90, 92, and 94 of the ledges or other radial impact structures 72, 74, 76, 78, 80, and 82 provided on the exterior 70 of the burner wall 10. These reduced pressure areas operate to increase the amount of flue gas which is entrained in the fuel streams, improve the mixing of the fuel, flue gas and oxygen source, stabilize the primary, secondary, and tertiary fuel streams 18, 20 and 22, and stabilize the burner combustion zone 24 and the burner flame.

In the inventive burner apparatus 2, the risers 62 for the primary fuel ejection structures 12 preferably extend forwardly through the surrounding outer skirt 68 of the burner wall 10 such that (a) the primary fuel ejection structures 12 are positioned in or at least partially forward of openings 96 provided in the forward face 88 of the forward secondary radial impact ledge 76 and (b) the secondary fuel ejection structures 14 are located in or at least partially forward of openings 98 provided in the forward face 92 of the forward tertiary radial impact ledge 80. Consequently, the primary fuel ejection structures 12 preferably eject the primary fuel streams 18 forwardly toward the combustion zone 24 from, or substantially from, the forward face 88 of the forward secondary radial impact ledge 76. Similarly, the secondary fuel ejection structures 14 preferably eject the secondary fuel streams 20 forwardly toward the combustion zone 24 from, or substantially from, the forward face 92 of the forward tertiary radial impact ledge 80.

As illustrated in FIG. 2, gap areas 100 are provided between the primary fuel ejection structures 12 which surround or at least partially surround the burner flow passageways. Similarly, gap areas 102 are provided between the secondary fuel ejection structures 14 and gap areas 104 are provided between the tertiary fuel ejection structures 16. In the inventive burner 2, the secondary fuel streams 20 can be ejected either (a) toward or over the primary ejection structures 12, (b) toward or over the gap areas 100 between the primary fuel ejection structures 12, or (c) both. Similarly, the tertiary fuel streams 22 can be eject either (a) toward or over the secondary fuel ejection structures 14, (b) toward or over the gap areas 102 between the secondary fuel ejection structures 14, or (c) both.

In order to prevent the secondary fuel streams 20 from interfering with the ejection and free jet flow of the primary fuel streams 18, the secondary fuel ejection structures 14 are preferably off-set from the primary fuel ejection structures 12 such that the secondary fuel streams 20 are ejected into or over the gap areas 100 provided between the primary fuel ejection structures 12. Similarly, in order to prevent the tertiary fuel streams 22 from interfering with the ejection and free jet flow of the secondary fuel streams 20, the tertiary fuel ejection structures 16 are preferably off-set from the secondary fuel ejection structures 14 such that the tertiary fuel streams 22 are ejected into or over the gap areas 102 provided between the secondary fuel ejection structures 14.

As indicated above, the lateral cross-sectional shape of the burner wall body 10 of inventive burner 2 can be circular, square, rectangular, oval or generally any other desired shape. In addition, although in most embodiments and applications of the inventive burner 2 the burner wall 10 and the two or more series of fuel ejection structures 12, 14, and 16 employed in the inventive burner 2 will entirely surround the flow passageway 8 for the oxygen source stream 6, in some applications this will not be the case. For example, the burner wall 10 and/or the fuel ejection structures 12, 14, and 16 may not completely surround the flow passageway 8 in certain applications where the inventive burner apparatus 2 is used in a furnace sidewall location or must be specially configured to provide a particular desired flame shape.

Although three series of surrounding fuel ejection structures 12, 14, and 16 are used in the embodiment 2 of the inventive burner illustrated in FIGS. 1 and 2, it was noted above that the inventive burner apparatus could alternatively include only two series of surrounding fuel ejection structures 12 and 14 or could have four, five, or more series of fuel ejection structures. Proceeding rearwardly, each additional succeeding series of fuel ejection structures would preferably be located rearwardly of and radially outwardly from the preceding series of fuel ejection structures.

Also, for each such additional succeeding series of fuel ejection structures, one or more (preferably two) additional radial impact structures, for contacting by the fuel streams ejected by the added series of ejection structures, would preferably be added to the exterior 70 of the burner wall 10 between the added series of ejection structures and the preceding series of ejection structures. Proceeding rearwardly, the lateral diameter or width of each added radial impact structure would preferably be greater than the diameter or width of the preceding impact structure.

In the method of the present invention, the stream of air or other oxygen source 6 is discharged into the combustion zone 24 of the inventive burner apparatus 2 from the discharge opening 32 of the burner flow passaged 8 at the forward longitudinal end 30 of the burner wall 10. At the same time, the primary fuel streams 18, the secondary fuel streams 20, and the tertiary fuel streams 22 are also discharged outside of the burner wall 10 toward the combustion zone 24 from the series of primary fuel ejection structures 12, the series of secondary fuel ejection structures 14, and the series of tertiary fuel ejection structures 16.

As the primary fuel streams 18 travel outside of the burner wall 10 along the primary fuel flow paths 48, at least a portion of the each of the primary fuel streams 18 contacts the rearward primary radial impact ledge 74 on the exterior of the 70 of the burner wall 10. Then, as the primary fuel streams 18 continue along the primary fuel flow paths 48, at least a portion of each of the primary fuel streams 18 also contacts the forward primary radial impact ledge 72 (i.e., the forward end 30) of the burner wall 10.

The reduced pressure area created by the momentum of the primary fuel streams 18 on the forward face 86 of the rearward primary impact ledge 74, and the increased turbulence created by the contact of the primary fuel streams 18 with the rearward primary ledge 74, operate to enhance the entrainment and mixing of the gaseous products of combustion 38 in the combustion chamber 36 with the primary fuel streams 18. As the primary fuel streams 18 then continue to flow to the combustion zone 24, the reduced pressure area created by the momentum of the primary fuel streams 18 and the flow momentum of the oxygen source stream 6 on the forward face 84 of the forward end 30 of the burner wall 10, and the turbulence created by the contact of the primary fuel steams 18 with the forward end 30 of the burner wall 10, not only enhance the entrainment and mixing of an additional amount of flue gas 38 with the primary fuel streams 18, but also operate to enhance the mixing of the oxygen source 6 with the primary fuel streams 18 at the beginning end 60 of the combustion zone 24 and to stabilize the combustion zone 24 and the burner flame at the forward end 30 of the burner wall 10.

As the secondary fuel streams 20 travel outside of the burner wall 10 along the secondary fuel flow paths 50, at least a portion of the each of the secondary fuel streams 20 contacts the rearward secondary radial impact ledge 78 on the exterior of the 70 of the burner wall 10. Then, as the secondary fuel streams 20 continue along the secondary fuel flow paths 50, at least a portion of each of the secondary fuel streams 20 also contacts the forward secondary radial impact ledge 76.

The reduced pressure areas created by the momentum of the secondary fuel streams 20 on the forward faces 90 and 88 of the rearward and forward secondary impact ledges 78 and 76, and the increased turbulence created by the contact of the secondary fuel streams 20 with the rearward and forward secondary ledges 78 and 76, operate to enhance the entrainment and mixing of the gaseous products of combustion 38 with the secondary fuel streams 20.

As the tertiary fuel streams 22 travel outside of the burner wall body 10 along the tertiary fuel flow paths 52, at least a portion of each of the tertiary fuel streams 22 contacts the rearward tertiary radial impact ledge 82 on the exterior of the 70 of the burner wall 10. Then, as the tertiary fuel streams 22 continue along the tertiary fuel flow paths 52, at least a portion of each of the tertiary fuel streams 22 also contacts the forward tertiary radial impact ledge 80.

The reduced pressure area created by the momentum of the tertiary fuel streams 22 on the forward faces 94 and 92 of the rearward and forward tertiary impact ledges 82 and 80, and the increased turbulence created by the contact of the tertiary fuel streams 22 with the rearward and forward tertiary ledges 82 and 80, operate to enhance the entrainment and mixing of the gaseous products of combustion 38 with the tertiary fuel streams 22.

In addition, it is further preferred that: (i) as the secondary fuel streams 20 travel along the secondary fuel flow paths 50, at least a portion of each of the secondary fuel steams 20 also contacts the rearward primary impact ledge 74 and at least a portion of each of the secondary fuel streams 20 further contacts the forward primary radial impact ledge 72 (i.e., the forward end 30) of the burner wall 10; (ii) as the tertiary fuel streams 22 travel along the tertiary fuel flow paths 52, at least a portion of each of the tertiary fuel steams 22 also contacts the rearward secondary impact ledge 78 and at least a portion of each of the tertiary fuel streams 22 further contacts the forward secondary radial impact ledge 76; and (ii) as the tertiary fuel streams 22 continue to travel along the tertiary fuel flow paths 52, at least a portion of each of the tertiary fuel steams 22 also contacts the rearward primary impact ledge 74 and at least a portion of each of the tertiary fuel streams 22 further contacts the forward primary radial impact ledge 72 (i.e., the forward end 30) of the burner wall 10.

The positioning of the secondary impact structures 78 and 76 in the flow paths 52 of the tertiary fuel streams 22 and the positioning of the primary impact structures 74 and 72 in the flow paths 50 and 52 of the secondary fuel streams 20 and the tertiary fuel streams 22 operates to further enhance both (a) the low pressure areas on the forward faces 90, 88, 86, and 84 of these impact structures and (b) the mixing of the gaseous products of combustion 38 with the tertiary and secondary fuel streams 22 and 20. In addition, the preferred positioning of the forward end 30 of the burner wall body 10 in the flow paths 48, 50, and 52 of all of the primary, secondary, and tertiary fuel streams 18, 20, and 22 provides a highly stable, single stage combustion zone 24 and flame at the forward end 30 of the burner wall 10 wherein at least a portion of each of the primary, secondary, and tertiary fuel streams 18, 20, and 22 is delivered to and combusted at the beginning end 60 of the combustion zone 24.

To prevent the secondary fuel steams 20 from interfering with the free jet flow and flue gas entrainment of the primary fuel streams 18, the secondary fuel streams 20 are preferably ejected toward the gap areas 100 between the primary fuel ejection structures 12 as illustrated in FIG. 2. To prevent the tertiary fuel steams 22 from interfering with the free jet flow and flue gas entrainment of the secondary fuel streams 20, the tertiary fuel streams 22 are preferably ejected toward the gap areas 102 between the secondary fuel ejection structures 14 as illustrated in FIG. 2.

Because of the increased travel distance outside of the burner wall 10 and the increasing number of impact structures on the exterior 70 of the burner wall 10 which are contacted, the total amount of flue gas 38 which is entrained in and mixes with the secondary fuel streams 20 is greater than the amount of flue gas 38 which mixes with the primary fuel streams 18. Moreover, for the same reasons, the total amount of flue gas 38 which is entrained in and mixes with the tertiary fuel streams 22 is greater than the amount of flue gas 38 which mixes with the secondary fuel streams 20.

The amount of flue gas 38 contained in the fully conditioned primary fuel streams 18 which are delivered to the combustion zone 24 will be in the range of from about 80% to about 90% by volume based upon the total final volume of the fully conditioned primary fuel streams 18. The amount of flue gas 38 contained in the fully conditioned secondary fuel streams 20 delivered to the combustion zone 24 will be in the range of from about 92% to about 94% by volume based upon the total final volume of the fully conditioned secondary fuel streams 20. The amount of flue gas 38 contained in the fully conditioned tertiary fuel streams 22 delivered to the combustion zone 24 will be in the range of from about 94% to about 96% by volume based upon the total final volume of the fully conditioned primary fuel streams 22.

In addition to significantly increasing the amount of the gaseous products of combustion 38 which are entrained in and mixed with the secondary and tertiary flow streams 20 and 22, the inventive burner apparatus 2 provides further enhanced internal flue gas recirculation (IFGR) by reducing the amount of fuel which must be used in the fuel rich primary fuel streams 18 in order to stabilize the burner combustion zone 24 and the burner flame. This is due to the fact that, unlike prior burners, the stability of the secondary and tertiary fuel streams is also greatly enhanced by placing ledges or other radial exterior impact structures 82, 80, 78, 76, and/or 74, as well the forward impact ledge 72 at the forward end 30 of the burner wall 10, in the flow paths 52 and 54 of these fuel streams.

Thus, the present invention is well adapted to carry out the objectives and attain the ends and advantages mentioned above as well as those inherent therein. While presently preferred embodiments and steps have been described for purposes of this disclosure, the invention is not limited in its application to the details of the preferred embodiments and steps. Numerous changes and modifications will be apparent to those in the art. Such changes and modifications are encompassed within this invention as defined by the claims. In addition, unless expressly stated, the phraseology and terminology employed herein are for the purpose of description and not of limitation.

What is claimed is:

1. A burner apparatus for discharging a burner flame in a heating system having inert gaseous products of combustion therein, the burner apparatus comprising:

a burner wall having a forward longitudinal end and an exterior;

a flow passageway for air or other oxygen source which extends through the burner wall, the flow passageway having a discharge at the forward longitudinal end of the burner wall from which the air or other oxygen source is discharged into a combustion zone;

a series of primary fuel ejectors positioned outside of the flow passageway which are located rearwardly of and radially outward from the forward longitudinal end of the burner wall and are located rearwardly of the combustion zone, each of the primary fuel ejectors having one or more ejection ports being oriented to eject a primary fuel stream along a primary fuel flow path which travels outside of the burner wall, through the inert products of combustion, prior to reaching the combustion zone;

at least one primary radial impact structure which is provided on the exterior of the burner wall and is positioned forwardly of the series of primary fuel ejectors in the primary fuel flow path of the primary fuel stream ejected by each of the primary fuel ejectors;

a series of secondary fuel ejectors, positioned outside of the flow passageway, which are located rearwardly of and radially outward from the primary fuel ejectors, each of the secondary fuel ejectors having one or more ejection ports oriented to eject a secondary fuel stream along a secondary fuel flow path which travels outside of the burner wall, through the inert products of combustion, prior to reaching the combustion zone; and at least one secondary radial impact structure which is provided on the exterior of the burner wall and is positioned rearwardly of the at least one primary radial impact structure, and forwardly of the series of secondary fuel ejectors, in the secondary fuel flow path of the secondary fuel stream ejected by each of the secondary fuel ejectors, the at least one primary radial impact structure on the exterior of the burner wall also being positioned in the secondary fuel flow paths so that the secondary fuel stream ejected by each of the secondary fuel ejectors travels outside of the burner wall through the inert products of combustion to the at least one secondary radial impact structure and then travels outside of the burner wall from the at least one secondary radial impact structure through the inert products of combustion to the at least one primary radial impact structure and to the combustion zone.

2. The burner apparatus of claim 1 wherein the series of primary fuel ejectors and the series of secondary fuel ejectors each surrounds the flow passageway and the at least one primary radial impact structure and the at least one secondary radial impact structure each surrounds the burner wall.

3. The burner apparatus of claim 1 wherein the at least one primary radial impact structure is a forward primary radial impact structure and the burner apparatus further comprises a rearward primary radial impact structure which is provided on the exterior of the burner wall, the rearward primary radial impact structure being positioned rearwardly of the forward primary radial impact structure, and forwardly of the at least one secondary radial impact structure, in the primary fuel flow path of the primary fuel stream ejected by each of the primary fuel ejectors, and also in the secondary fuel flow path of the secondary fuel stream ejected by each of the secondary fuel ejectors, so that the primary fuel stream ejected by each of the primary fuel ejectors travels outside of the burner wall, through the inert products of combustion, to the rearward primary radial impact structure and then travels from the rearward primary radial impact structure through the inert products of combustion to the forward primary radial impact structure and to the combustion zone and the secondary fuel stream ejected by each of the secondary fuel ejectors travels outside of the burner wall, through the inert products of combustion, from the at least one secondary radial impact structure to the rearward primary radial impact structure and then travels from the rearward primary radial impact structure through the inert products of combustion to the forward primary radial impact structure and to the combustion zone.

4. The burner apparatus of claim 3 wherein:

the at least one secondary radial impact structure is a forward secondary radial impact structure and the burner apparatus further comprises a rearward secondary radial impact structure which is provided on the exterior of the burner wall and is positioned rearwardly of the forward secondary radial impact structure, in the secondary fuel flow path of the secondary fuel stream ejected by each of the secondary fuel ejectors, so that the secondary fuel stream ejected by each of the secondary fuel ejectors travels outside of the burner wall, through the inert products of combustion, to the rearward secondary radial impact structure and then travels from the rearward secondary radial impact structure through the inert products of combustion to the forward secondary radial impact structure.

5. The burner apparatus of claim 4 wherein:

the forward primary radial impact structure on the exterior of the burner wall is a radial ledge formed on the forward longitudinal end of the burner wall;

the rearward primary radial impact structure is a radial ledge which is formed on the exterior of the burner wall and has an outer diameter or width which is greater than an outer diameter or width of the radial ledge formed on the forward longitudinal end of the burner wall;

the forward secondary radial impact structure is a radial ledge which is formed on the exterior of the burner wall and has an outer diameter or width which is greater than the outer diameter or width of the rearward primary radial impact structure; and the rearward secondary radial impact structure is a radial ledge which is formed on the exterior of the burner wall and has an outer diameter or width which is greater than the outer diameter or width of the forward secondary radial impact structure.

6. The burner apparatus of claim 4 further comprising openings for the series of primary fuel ejectors provided in a forward face of the forward secondary radial impact structure.

7. The burner apparatus of claim 1 wherein the combustion zone is a single stage combustion zone having only one combustion stage for combusting both the primary fuel streams ejected from the primary fuel and the secondary fuel streams ejected from the secondary fuel ejectors.

8. The burner apparatus of claim 1 wherein:

the primary fuel ejectors in the series of primary fuel ejectors are spaced apart by gap areas between the primary fuel ejectors and the secondary fuel flow paths for the secondary fuel streams ejected from the secondary fuel ejectors are directed toward or over the gap areas between the primary fuel ejectors.

9. The burner apparatus of claim 1 further comprising:

a series of tertiary fuel ejectors, positioned outside of the flow passageway, which are located rearwardly of and radially outward from the secondary fuel ejectors, each of the tertiary fuel ejectors having one or more ejection ports oriented to eject a tertiary fuel stream along a tertiary fuel flow path which travels outside of the burner wall, through the inert products of combustion, prior to reaching the combustion zone and at least one tertiary radial impact structure which is provided on the exterior of the burner wall and is positioned rearwardly of the at least one secondary radial impact structure, and forwardly of the series of tertiary fuel ejectors, in the tertiary fuel flow path of the tertiary fuel stream ejected by each of the tertiary fuel ejectors, the at least one primary radial impact structure on the exterior of the burner wall and the at least one secondary radial impact structure on the exterior of the burner wall also being in the tertiary flow paths so that the tertiary fuel stream ejected by each of the tertiary fuel ejectors (i) travels outside of the burner wall through the inert products of combustion to the at least one tertiary radial impact structure, (ii) then travels outside of the burner wall from the at least one tertiary radial impact structure, through the inert products of combustion, to the at least one secondary radial impact structure, and (iii) then travels outside of the burner wall from the at least one secondary radial impact structure through the inert products of combustion to the at least one primary radial impact structure and to the combustion zone.

10. The burner apparatus of claim 9 wherein the series of primary fuel ejectors, the series of secondary fuel ejectors, and the series of tertiary fuel ejectors each surrounds the flow passageway and the at least one primary radial impact structure, the at least one secondary radial impact structure, and the at least one tertiary radial impact structure each surrounds the burner wall.

11. The burner apparatus of claim 9 wherein the at least one primary radial impact structure is a forward primary radial impact structure;

the burner apparatus further comprises a rearward primary radial impact structure which is provided on the exterior of the burner wall and is positioned rearwardly of the forward primary radial impact structure, in (i) the primary fuel flow path of the primary fuel stream ejected by each of the primary fuel ejectors, (ii) the secondary fuel flow path of the secondary fuel stream ejected by each of the secondary fuel ejectors, and (iii) the tertiary fuel flow path of the tertiary fuel stream ejected by each of the tertiary fuel ejectors;

the at least one secondary radial impact structure is a forward secondary radial impact structure;

the burner apparatus further comprises a rearward secondary radial impact structure which is provided on the exterior of the burner wall and is positioned rearwardly of the forward secondary radial impact structure in (i) the secondary fuel flow path of the secondary fuel stream ejected by each of the secondary fuel ejectors and (ii) the tertiary fuel flow path of the tertiary fuel stream ejected by each of the tertiary fuel ejectors;

the at least one tertiary radial impact structure is a forward tertiary radial impact structure; and the burner apparatus further comprises a rearward tertiary radial impact structure which is provided on the exterior of the burner wall and is positioned rearwardly of the forward tertiary radial impact structure, in the tertiary fuel flow path of the tertiary fuel stream ejected by each of the tertiary fuel ejectors.

12. The burner apparatus of claim 11 wherein:

the forward primary radial impact structure on the exterior of the burner wall is a radial ledge formed on the forward longitudinal end of the burner wall;

the rearward primary radial impact structure is a radial ledge which is formed on the exterior of the burner wall and has an outer diameter or width which is greater than an outer diameter or width of the radial ledge formed on the forward longitudinal end of the burner wall;

the forward secondary radial impact structure is a radial ledge which is formed on the exterior of the burner wall and has an outer diameter or width which is greater than the outer diameter or width of the rearward primary radial impact structure;

the rearward secondary radial impact structure is a radial ledge which is formed on the exterior of the burner wall and has an outer diameter or width which is greater than the outer diameter or width of the forward secondary radial impact structure;

the forward tertiary radial impact structure is a radial ledge which is formed on the exterior of the burner wall and has an outer diameter or width which is greater than the outer diameter or width of the rearward secondary radial impact structure; and the rearward tertiary radial impact structure is a radial ledge which is formed on the exterior of the burner wall and has an outer diameter or width which is greater than the outer diameter or width of the forward tertiary radial impact structure.

13. The burner apparatus of claim 11 further comprising:

openings for the series of primary fuel ejectors provided in a forward face of the forward secondary radial impact structure and openings for the series of secondary fuel ejectors provided in a forward face of the forward tertiary radial impact structure.

14. The burner apparatus of claim 9 wherein:

the primary fuel ejectors in the series of primary fuel ejectors are spaced apart by gap areas between the primary fuel ejectors;

the secondary fuel flow paths for the secondary fuel streams ejected from the secondary fuel ejectors are directed toward or over the gap areas between the primary fuel ejectors;

the secondary fuel ejectors in the series of secondary fuel ejectors are spaced apart by gap areas between the secondary fuel ejectors; and the tertiary fuel flow paths for the tertiary fuel streams ejected from the tertiary fuel ejectors are directed toward or over the gap areas between the secondary fuel ejectors.

15. The burner apparatus of claim 9 wherein the combustion zone is a single stage combustion zone having only one combustion stage for combusting the primary fuel streams ejected from the primary fuel ejectors, the secondary fuel streams ejected from the secondary fuel ejectors, and the tertiary fuel streams ejected from the tertiary fuel ejectors.

16. A burner apparatus for discharging a burner flame in a heating system having gaseous products of combustion therein, the burner apparatus comprising:

a burner wall having a forward longitudinal end and an exterior;

a flow passageway for air or other oxygen source which extends through and is surrounded by the burner wall, the flow passageway having a discharge at the forward longitudinal end of the burner wall from which the air or other oxygen source is discharged into a combustion zone;

a series of primary fuel ejection structures which are positioned outside of and which surround the flow passageway, the primary fuel ejection structures being located rearwardly of and radially outward from the forward longitudinal end of the burner wall and each of the primary fuel ejection structures being oriented to eject a primary fuel stream along a primary fuel flow path outside of the burner wall toward the combustion zone;

at least one primary radial impact structure which is provided on the exterior of the burner wall and is positioned in the primary fuel flow paths for contacting at least a portion of the primary fuel stream ejected by each of the primary fuel ejection structures;

a series of secondary fuel ejection structures which are positioned outside of and which surround the flow passageway, the secondary fuel ejection structures being located rearwardly of and radially outward from the primary fuel ejection structures and each of the secondary fuel ejection structures being oriented to eject a secondary fuel stream along a secondary fuel flow path outside of the burner wall toward the combustion zone;

at least one secondary radial impact structure which is provided on the exterior of the burner wall and is positioned rearwardly of the at least one primary radial impact structure, in the secondary fuel flow paths, for contacting at least a portion of the secondary fuel stream ejected by each of the secondary fuel ejection structures;

a series of tertiary fuel ejection structures which are positioned outside of and which surround the flow passageway, the tertiary fuel ejection structures being located rearwardly of and radially outward from the secondary fuel ejection structures and each of the tertiary fuel ejection structures being oriented to eject a tertiary fuel stream along a tertiary fuel flow path outside of the burner wall toward the combustion zone;

at least one tertiary radial impact structure which is provided on the exterior of the burner wall and is positioned rearwardly of the at least one secondary radial impact structure, in the tertiary fuel flow paths, for contacting at least a portion of the tertiary fuel stream ejected by each of the tertiary fuel ejection structures; and the at least one secondary radial impact structure on the exterior of the burner wall also being positioned in the tertiary fuel flow paths for contacting at least a portion of the tertiary fuel stream ejected by each of the tertiary fuel ejection structures.

17. The burner apparatus of claim 16 wherein the at least one primary radial impact structure on the exterior of the burner wall body is also positioned in the tertiary fuel flow paths for contacting at least a portion of the tertiary fuel stream ejected by each of the tertiary fuel ejection structures.

18. A burner apparatus for discharging a burner flame in a heating system having gaseous products of combustion therein, the burner apparatus comprising:

a burner wall having a forward longitudinal end and an exterior;

a flow passageway for air or other oxygen source which extends through and is surrounded by the burner wall, the flow passageway having a discharge at the forward longitudinal end of the burner wall from which the air or other oxygen source is discharged into a combustion zone;

a series of primary fuel ejection structures which are positioned outside of and which surround the flow passageway, the primary fuel ejection structures being located rearwardly of and radially outward from the forward longitudinal end of the burner wall and each of the primary fuel ejection structures being oriented to eject a primary fuel stream along a primary fuel flow path outside of the burner wall toward the combustion zone;

at least one primary radial impact structure which is provided on the exterior of the burner wall and is positioned in the primary fuel flow paths for contacting at least a portion of the primary fuel stream ejected by each of the primary fuel ejection structures;

a series of secondary fuel ejection structures which are positioned outside of and which surround the flow passageway, the secondary fuel ejection structures being located rearwardly of and radially outward from the primary fuel ejection structures and each of the secondary fuel ejection structures being oriented to eject a secondary fuel stream along a secondary fuel flow path outside of the burner wall toward the combustion zone;

at least one secondary radial impact structure which is provided on the exterior of the burner wall and is positioned rearwardly of the at least one primary radial impact structure, in the secondary fuel flow paths, for contacting at least a portion of the secondary fuel stream ejected by each of the secondary fuel ejection structures;

a series of tertiary fuel ejection structures which are positioned outside of and which surround the flow passageway, the tertiary fuel ejection structures being located rearwardly of and radially outward from the secondary fuel ejection structures and each of the tertiary fuel ejection structures being oriented to eject a tertiary fuel stream along a tertiary fuel flow path outside of the burner wall toward the combustion zone;

at least one tertiary radial impact structure which is provided on the exterior of the burner wall and is positioned rearwardly of the at least one secondary radial impact structure, in the tertiary fuel flow paths, for contacting at least a portion of the tertiary fuel stream ejected by each of the tertiary fuel ejection structures, the at least one primary radial impact structure being a forward primary radial impact structure;

a rearward primary radial impact structure which is provided on the exterior of the burner wall and is positioned rearwardly of the forward primary radial impact structure, in the primary fuel flow paths, for contacting at least a portion of the primary fuel stream ejected by each of the primary fuel ejection structures;

the at least one secondary radial impact structure being a forward secondary radial impact structure;

a rearward secondary radial impact structure which is provided on the exterior of the burner wall and is positioned rearwardly of the forward secondary radial impact structure, in the secondary fuel flow paths, for contacting at least a portion of the secondary fuel stream ejected by each of the secondary fuel ejection structures;

the at least one tertiary radial impact structure being a forward tertiary radial impact structure; and a rearward tertiary radial impact structure which is provided on the exterior of the burner wall and is positioned rearwardly of the forward tertiary radial impact structure, in the tertiary fuel flow paths, for contacting at least a portion of the tertiary fuel stream ejected by each of the tertiary fuel ejection structures.

19. The burner apparatus of claim 18 wherein:

the forward and rearward primary radial impact structures on the exterior of the burner wall are also positioned in the secondary fuel flow paths for contacting at least a portion of the secondary fuel stream ejected by each of the secondary fuel ejection structures;

the forward and rearward secondary radial impact structures on the exterior of the burner wall are also positioned in the tertiary fuel flow paths for contacting at least a portion of the tertiary fuel stream ejected by each of the tertiary fuel ejection structures; and the forward and rearward primary radial impact structures on the exterior of the burner wall are also positioned in the tertiary fuel flow paths for contacting at least a portion of the tertiary fuel stream ejected by each of the tertiary fuel ejection structures.

20. The burner apparatus of claim 19 wherein:

the forward primary radial impact structure on the exterior of the burner wall is a radial ledge formed on the forward longitudinal end of the burner wall;

the rearward primary radial impact structure is a radial ledge which is formed on the exterior of the burner wall and has an outer diameter or width which is greater than an outer diameter or width of the radial ledge formed on the forward longitudinal end of the burner wall;

the forward secondary radial impact structure is a radial ledge which is formed on the exterior of the burner wall and has an outer diameter or width which is greater than the outer diameter or width of the rearward primary radial impact structure;

the rearward secondary radial impact structure is a radial ledge which is formed on the exterior of the burner wall and has an outer diameter or width which is greater than the outer diameter or width of the forward secondary radial impact structure;

the forward tertiary radial impact structure is a radial ledge which is formed on the exterior of the burner wall and has an outer diameter or width which is greater than the outer diameter or width of the rearward secondary radial impact structure; and the rearward tertiary radial impact structure is a radial ledge which is formed on the exterior of the burner wall and has an outer diameter or width which is greater than the outer diameter or width of the forward tertiary radial impact structure.

21. The burner apparatus of claim 18 further comprising:

openings for the series of primary fuel ejection structures provided in a forward face of the forward secondary radial impact structure and openings for the secondary fuel ejection structures provided in a forward face of the forward tertiary radial impact structure.

22. A burner apparatus for discharging a burner flame in a heating system having gaseous products of combustion therein, the burner apparatus comprising:

a burner wall having a forward longitudinal end and an exterior;

a flow passageway for air or other oxygen source which extends through and is surrounded by the burner wall, the flow passageway having a discharge at the forward longitudinal end of the burner wall from which the air or other oxygen source is discharged into a combustion zone;

a series of primary fuel ejection structures which are positioned outside of and which surround the flow passageway, the primary fuel ejection structures being located rearwardly of and radially outward from the forward longitudinal end of the burner wall and each of the primary fuel ejection structures being oriented to eject a primary fuel stream along a primary fuel flow path outside of the burner wall toward the combustion zone;

at least one primary radial impact structure which is provided on the exterior of the burner wall and is positioned in the primary fuel flow paths for contacting at least a portion of the primary fuel stream ejected by each of the primary fuel ejection structures;

a series of secondary fuel ejection structures which are positioned outside of and which surround the flow passageway, the secondary fuel ejection structures being located rearwardly of and radially outward from the primary fuel ejection structures and each of the secondary fuel ejection structures being oriented to eject a secondary fuel stream along a secondary fuel flow path outside of the burner wall toward the combustion zone;

at least one secondary radial impact structure which is provided on the exterior of the burner wall and is positioned rearwardly of the at least one primary radial impact structure, in the secondary fuel flow paths, for contacting at least a portion of the secondary fuel stream ejected by each of the secondary fuel ejection structures;

a series of tertiary fuel ejection structures which are positioned outside of and which surround the flow passageway, the tertiary fuel ejection structures being located rearwardly of and radially outward from the secondary fuel ejection structures and each of the tertiary fuel ejection structures being oriented to eject a tertiary fuel stream along a tertiary fuel flow path outside of the burner wall toward the combustion zone; and at least one tertiary radial impact structure which is provided on the exterior of the burner wall and is positioned rearwardly of the at least one secondary radial impact structure, in the tertiary fuel flow paths, for contacting at least a portion of the tertiary fuel stream ejected by each of the tertiary fuel ejection structures, wherein the combustion zone is a single stage combustion zone having only one combustion stage for combusting the primary fuel streams ejected from the primary fuel ejection structures, the secondary fuel streams ejected from the secondary fuel ejection structures, and the tertiary fuel streams ejected from the tertiary fuel ejection structures.

* * * * *